US009016001B2

(12) United States Patent
Heger

(10) Patent No.: US 9,016,001 B2
(45) Date of Patent: Apr. 28, 2015

(54) ERECTABLE HOUSING STRUCTURE WITH A SHIPPING CONTAINER CONFIGURATION

(71) Applicant: Chad Buege Heger, Foothill Ranch, CA (US)

(72) Inventor: Chad Buege Heger, Foothill Ranch, CA (US)

( * ) Notice: Subject to any disclaimer, the term of this patent is extended or adjusted under 35 U.S.C. 154(b) by 0 days.

(21) Appl. No.: 13/828,013

(22) Filed: Mar. 14, 2013

(65) Prior Publication Data

US 2014/0144088 A1 May 29, 2014

Related U.S. Application Data

(60) Provisional application No. 61/731,379, filed on Nov. 29, 2012.

(51) Int. Cl.
*E04H 14/00* (2006.01)
*E04B 1/343* (2006.01)

(52) U.S. Cl.
CPC ..... *E04B 1/34357* (2013.01); *E04B 1/34384* (2013.01)

(58) Field of Classification Search
USPC ..... 52/79.1, 79.5, 79.9, 79.12, 64, 66, 69, 52/122.1, 282.3, 143
See application file for complete search history.

(56) References Cited

U.S. PATENT DOCUMENTS

| | | | | |
|---|---|---|---|---|
| 3,849,952 | A * | 11/1974 | Hanaoka | 52/79.5 |
| 5,491,934 | A | 2/1996 | Bigelow, Jr. et al. | |
| 5,661,930 | A | 9/1997 | Porter | |
| 5,950,373 | A | 9/1999 | von Hoff et al. | |
| 5,966,956 | A * | 10/1999 | Morris et al. | 62/259.1 |
| 6,712,414 | B2 * | 3/2004 | Morrow | 296/26.01 |
| 6,983,567 | B2 * | 1/2006 | Ciotti | 52/79.5 |
| 7,290,372 | B2 | 11/2007 | Aust et al. | |
| 7,475,514 | B2 | 1/2009 | Rulquin et al. | |
| 7,604,141 | B1 | 10/2009 | Taylor | |
| 7,828,367 | B2 | 11/2010 | Hickam et al. | |
| 7,882,659 | B2 | 2/2011 | Gyory et al. | |
| 8,141,304 | B2 | 3/2012 | Shen et al. | |
| 8,201,362 | B2 | 6/2012 | Alford et al. | |
| 2005/0210764 | A1 | 9/2005 | Foucher et al. | |
| 2011/0023925 | A1 * | 2/2011 | Johnson et al. | 135/139 |

FOREIGN PATENT DOCUMENTS

| | | |
|---|---|---|
| CN | 102021946 | 4/2011 |
| DE | 202008002754 | 8/2008 |
| KR | 101058355 B1 | 8/2011 |
| WO | 2004/106669 A1 | 12/2004 |

* cited by examiner

*Primary Examiner* — Charles A Fox
*Assistant Examiner* — Patrick Maestri
(74) *Attorney, Agent, or Firm* — Stetina Brunda Garred & Brucker

(57) ABSTRACT

An erectable portable housing structure is disclosed herein which has a plurality of panels that can be pivoted outward to form a two-story portable housing structure for the purpose of providing shelter for people or storage area. The portable housing structure may have an external envelope that can be transported through standard intermodal transportation systems. When the portable housing structure has been transported to a particular site, the panels within the portable housing structure may be pivoted outward to erect the two-story portable housing structure.

5 Claims, 14 Drawing Sheets

ERECTABLE HOUSING STRUCTURE WITH A SHIPPING CONTAINER CONFIGURATION

CROSS-REFERENCE TO RELATED APPLICATIONS

This application claims the benefits of U.S. provisional patent application Ser. No. 61/731,379, filed on Nov. 29, 2012, the entire contents of which is expressly incorporated herein by reference.

STATEMENT RE: FEDERALLY SPONSORED RESEARCH/DEVELOPMENT

Not Applicable

BACKGROUND

The present invention relates to a housing structure that is erectable from a shipping container configuration to a two-story housing structure.

When natural disaster strikes, the residents are displaced and may be without shelter for extended periods of time until permanent shelter can be built for the displaced residents. Other types of situations may occur that cause residents to be displaced and without shelter. By way of example and not limitation, military conflict, economic conditions, disease, etc. may cause large numbers of residents to move to a different location. When large numbers of people suddenly move from one location to another, it is difficult, if not impossible to provide shelter for all of these displaced refugees.

Accordingly, there is a need in the art for providing shelter.

BRIEF SUMMARY

The portable two story housing structure disclosed herein provides a convenient and easy device and method for quickly transporting a housing structure to a site. When collapsed, the portable two story housing structure may be transported through a standard intermodal transportation system including but not limited to trucking, shipping and railway. The structure when collapsed utilizes standard corner castings to ship the structure to a site. At the site, the structure unfolds into a two story housing structure capable of providing shelter to people and things. The structure has a plurality of panels that are stored in the collapsed structure and are later pivoted into position to form the floors, sidewalls, and roof of the two story housing structure. In this manner, when needed, the portable two story housing structure can be quickly deployed and erected at a site.

More particularly, a portable two story housing structure is disclosed. The structure may comprise a pair of first vertical end frames, a pair of second vertical end frames, corner castings, a top panel and opposed side panels. The pair of first vertical end frames may be sufficiently strong to support a second story of the portable two story housing structure and to stack one or more portable two story housing structures upon each other during transportation. The pair of second vertical end frames may be sufficiently strong to support the second story of the portable two story housing structure and to stack one or more portable two story housing structures upon each other during transportation. The corner castings may be fitted on opposed distal ends of the first and second vertical end frames wherein the corner castings are positioned so that the portable two story housing structure may be transported through a standard intermodal transportation system. The top panel may be disposed adjacent to the upper ends of the first and second vertical frame members. The top panel may be traversed upward so as to form a roof of the portable housing structure. The opposed side panels may be disposed adjacent to respective ones of the pair of first and second vertical end frames. The opposed side panels may be rotated into position to form side walls of the second story of the structure.

The structure may have additional panels disposed interior to the top panel and the opposed side panels. The side panels and the additional panels may be vertically oriented when the structure is in the collapsed state. The additional panels may be rotated into position to form the floor of the second story of the structure and the side walls and floor of the first story of the structure.

Level mechanisms may be disposed below the panels forming the first floor for leveling the first floor of the two story housing structure when erected.

The structure may also have pairs of upper and lower longitudinal members and pairs of upper and lower lateral members. The pairs of upper and lower longitudinal members may be attached to respective upper and lower distal end portions of the pairs of first and second vertical end frames. The pairs of upper and lower lateral members may be attached to respective upper and lower distal end portions of the pairs of first and second vertical end frames. The panels may be rotatably attached to the pairs of upper longitudinal members, pairs of lower longitudinal members and the pairs of first and second vertical end frames.

In another aspect, a method of erecting a portable two story housing structure is disclosed. The method may comprise the steps of traversing a top panel upward one story to form a roof of the structure; rotating side panels into position to form side walls of the second story of the structure; locking the side panels and the top panel; and forming a hermetic seal at all rotatable joints and edges of the side panels.

The method may further comprise the steps of rotating panels into position to form a first floor of the two story housing structure; and leveling the rotated panels forming the first floor of the two story housing structure.

In the method, the forming the hermetic seal step may include the step of extending a roof panel over the side panel so that rain cascades off of the roof and onto a ground.

In the method, the traversing step may include the step of extending a telescoping member attached to the top panel and locking the telescoping member to support the roof. Alternatively, the traversing step may include the step of rotating a pivoting mechanism to raise the roof panel and locking the pivoting mechanism when the roof panel is in position to support the roof panel.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
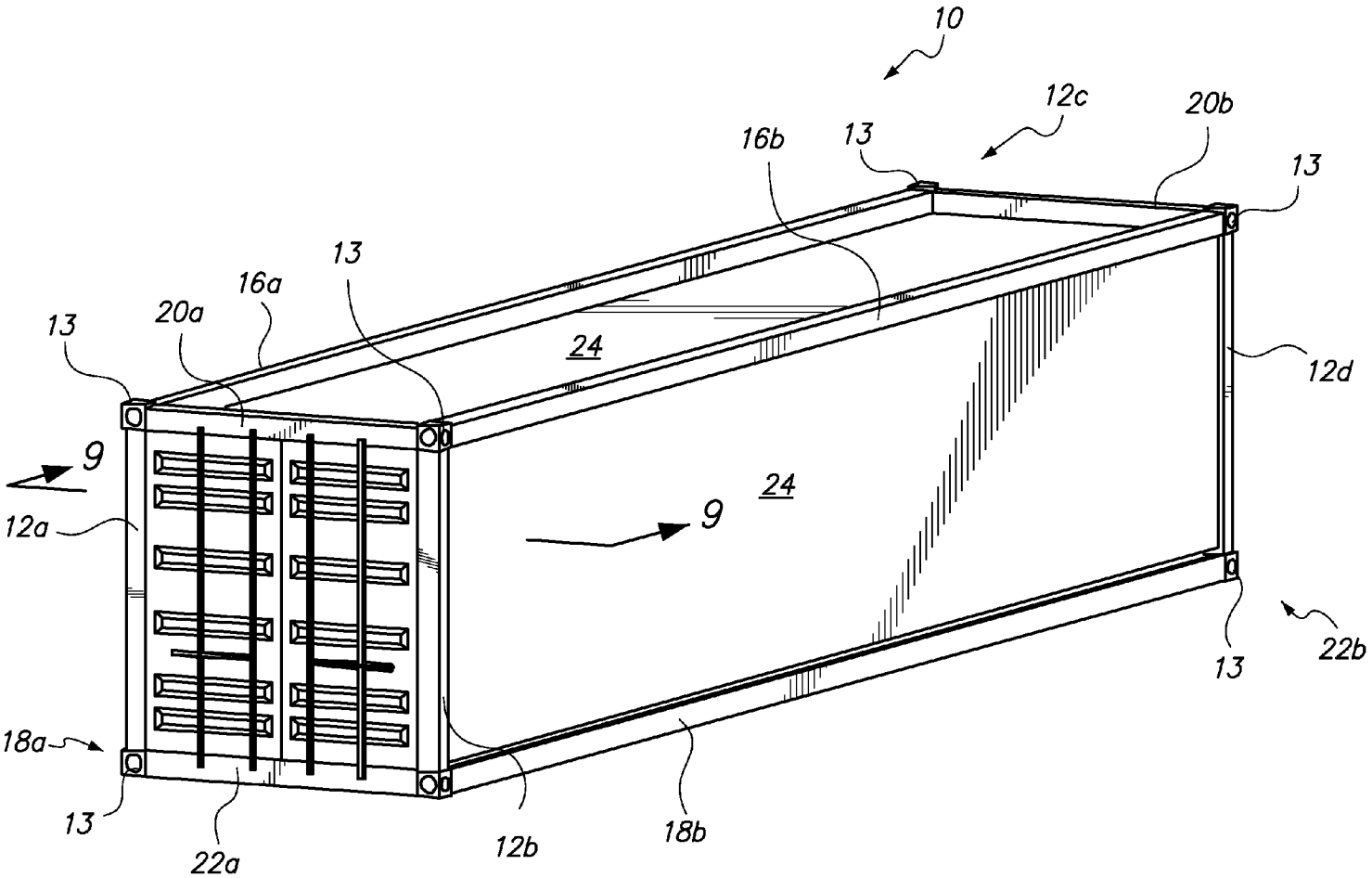
FIG. 1 is a perspective view of a first embodiment of a two-story housing structure in a collapsed state which is ready for transport via an intermodal transportation system.

Referring now to the drawings, a portable two-story housing structure 10, 100 that can be transported through a standard intermodal transportation system when collapsed (see FIG. 1) and erected (see FIG. 2) at a destination site to provide shelter to people or storage is disclosed. The portable two-story housing structure 10, 100 provides for a quick and convenient way of deploying shelter or storage to the destination site. The portable two-story housing structure 10, 100 is useful for deploying shelter or storage to an area that has been hit by a natural disaster such as a hurricane, tsunami or other natural disasters. Moreover, the portable two-story housing structure 10, 100 is also useful for providing shelter to low income areas as well as Third World countries. In other words, the structure 10, 100 may be transported as a single intermodal container and is capable of being erected to about an 1800 square feet structure 10, 100 with relatively minimal shipping and logistics costs for a structure 10, 100 that large.

Figure 2:
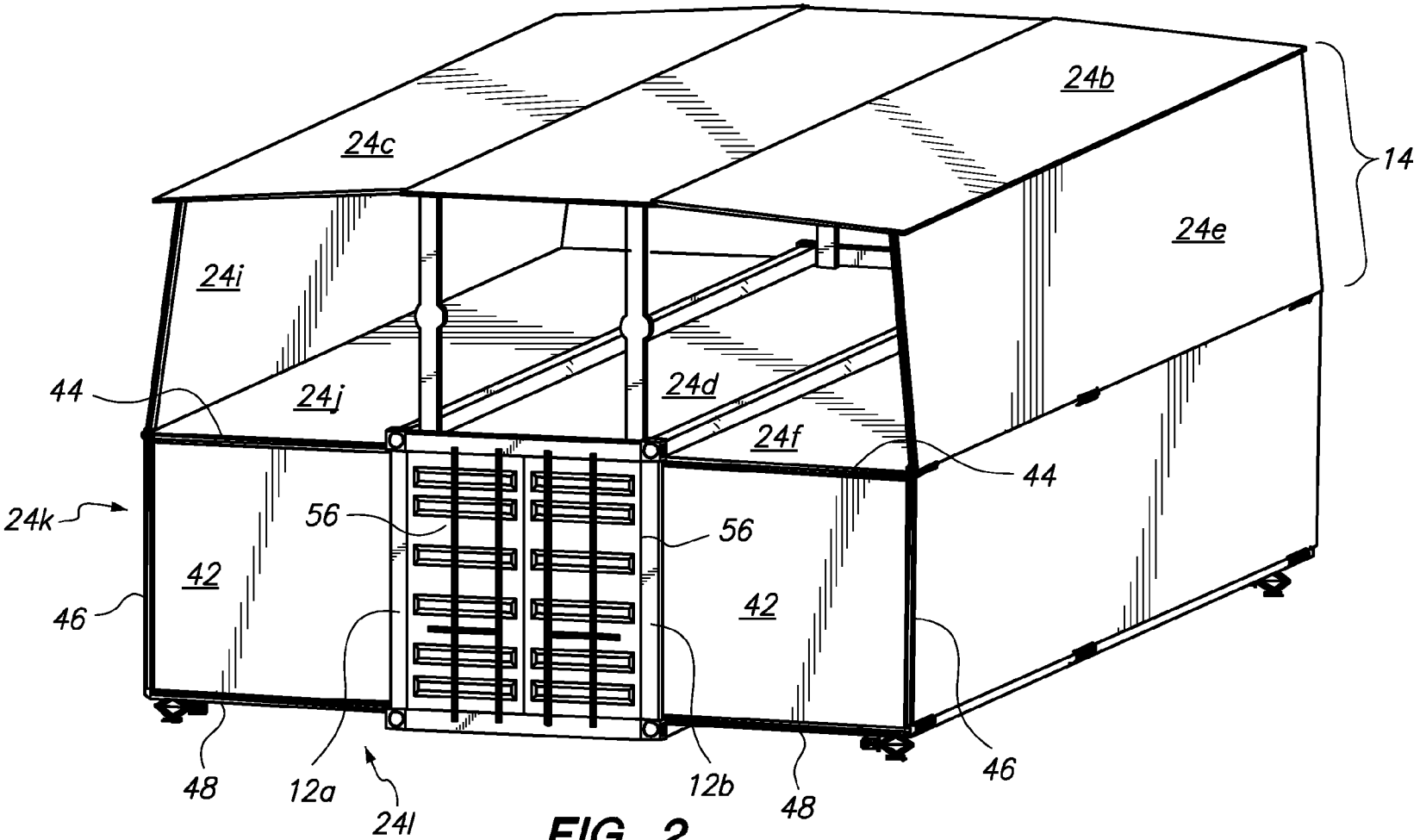
FIG. 2 is a perspective view of the two-story housing structure shown in FIG. 1 in an erected state after the two-story housing structure has been transported to a site.

Referring now to FIG. 1, the portable two-story housing structure 10 may have a pair of first vertical end frames 12*a, b* and a pair of second vertical end frames 12*c*, 12*d*. These vertical end frames 12*a-d* define the external envelope of the portable two-story housing structure 10 when collapsed. The vertical end frames 12*a-d* are also sufficiently strong and have corner castings 13 (e.g., cast twistlock corners) so that one or more collapsed portable two-story housing structures 10 can be stacked upon each other and transported via shipping, train or other standard intermodal transportation systems. Moreover, the vertical end frames 12*a-d* support the second story 14 of the portable two-story housing structure 10 when erected, as shown in FIG. 2.

The portable two-story housing structure 10 may also have a plurality of upper longitudinal members 16*a, b* to transfer the weight of the second story and its personnel and contents to the vertical end frames 12*a-d*. The longitudinal member 16*a, b* may be sufficiently strong and stiff to mitigate excessive bending of the longitudinal members 16*a, b* during transportation and under the weight of the personnel and contents during use. The upper longitudinal members 16*a, b* are attached to the upper distal ends of the pairs of first and second vertical end frames 12*a-d* (as shown) or the upper lateral members 20*a, b*. The portable two-story housing structure 10 may also have a plurality of lower longitudinal members 18*a, b* which are attached to the lower distal ends of the pairs of first and second vertical end frames 12*a-d* which provide structural support during transportation and when the structure 10 is erected.

The portable two-story housing structure 10 may also have a plurality of upper lateral members 20*a, b* and a plurality of lower lateral members 22*a, b*. The upper lateral members 20*a, b* are attached to the upper distal ends of the pair of first vertical end frames 12*a, b* and the upper distal ends of the pair of second vertical end frames 12*c, d*. The lower lateral members 22*a, b* are attached to the lower distal ends of the pair of first vertical end frames 12*a, b* and the lower distal ends of the pair of second vertical end frames 12*c, d*.

The pairs of first and second vertical end frames 12*a, d*, the upper longitudinal members 16*a, b*, the lower longitudinal members 18*a, b* and the upper and lower lateral members 20*a, b*, 22*a, b* define the overall external envelope of the portable two-story housing structure 10 when the structure 10 is collapsed (see FIG. 1). A plurality of panels 24 are stored within the overall external envelope that are later traversed (e.g., rotated or pivoted) to form the floors of the first and second story, side walls and roof of the portable two-story housing structure 10.

Figure 3:
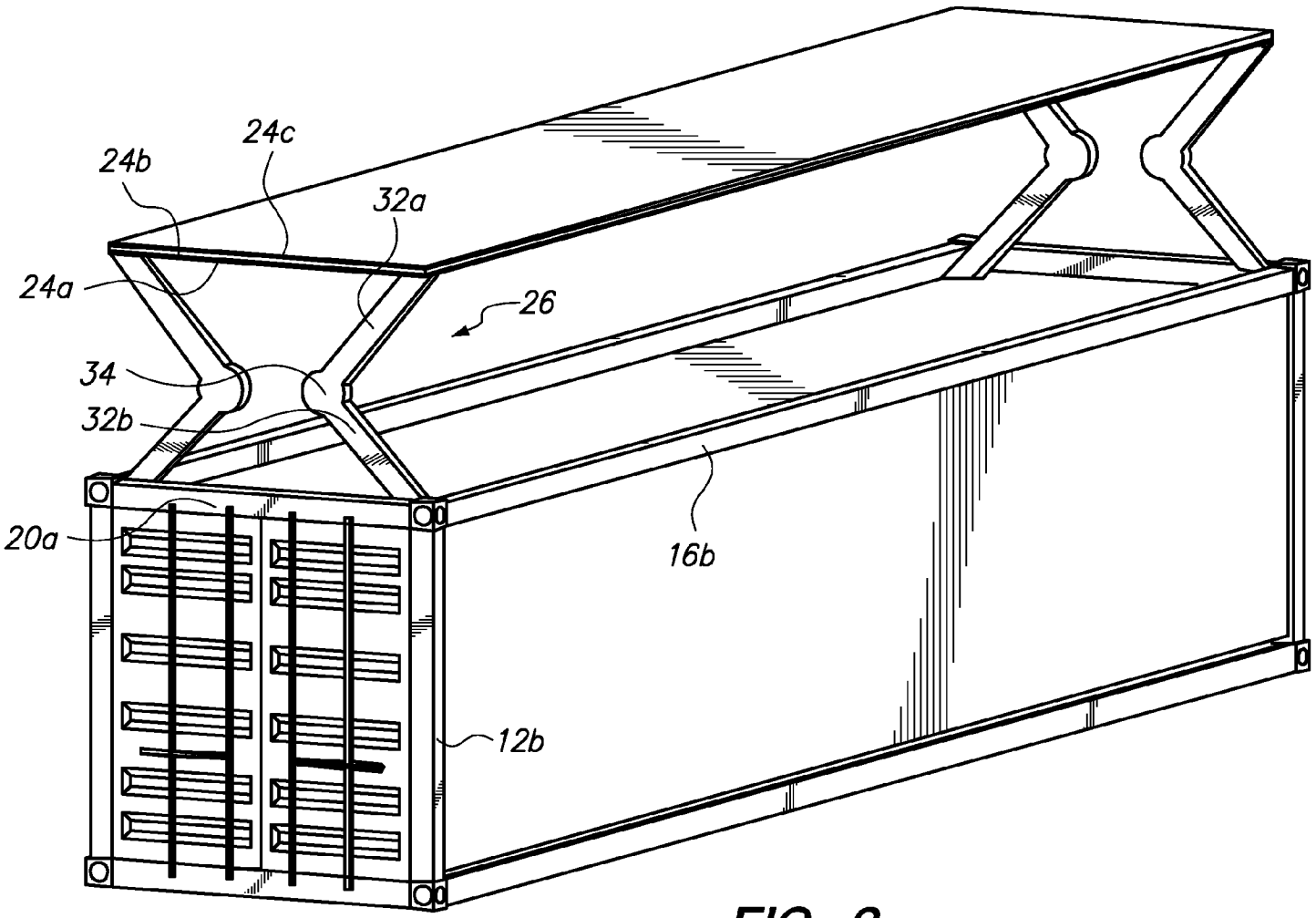
FIG. 3 illustrates a step of raising a roof of the two-story housing structure shown in FIG. 1.
Figure 4:
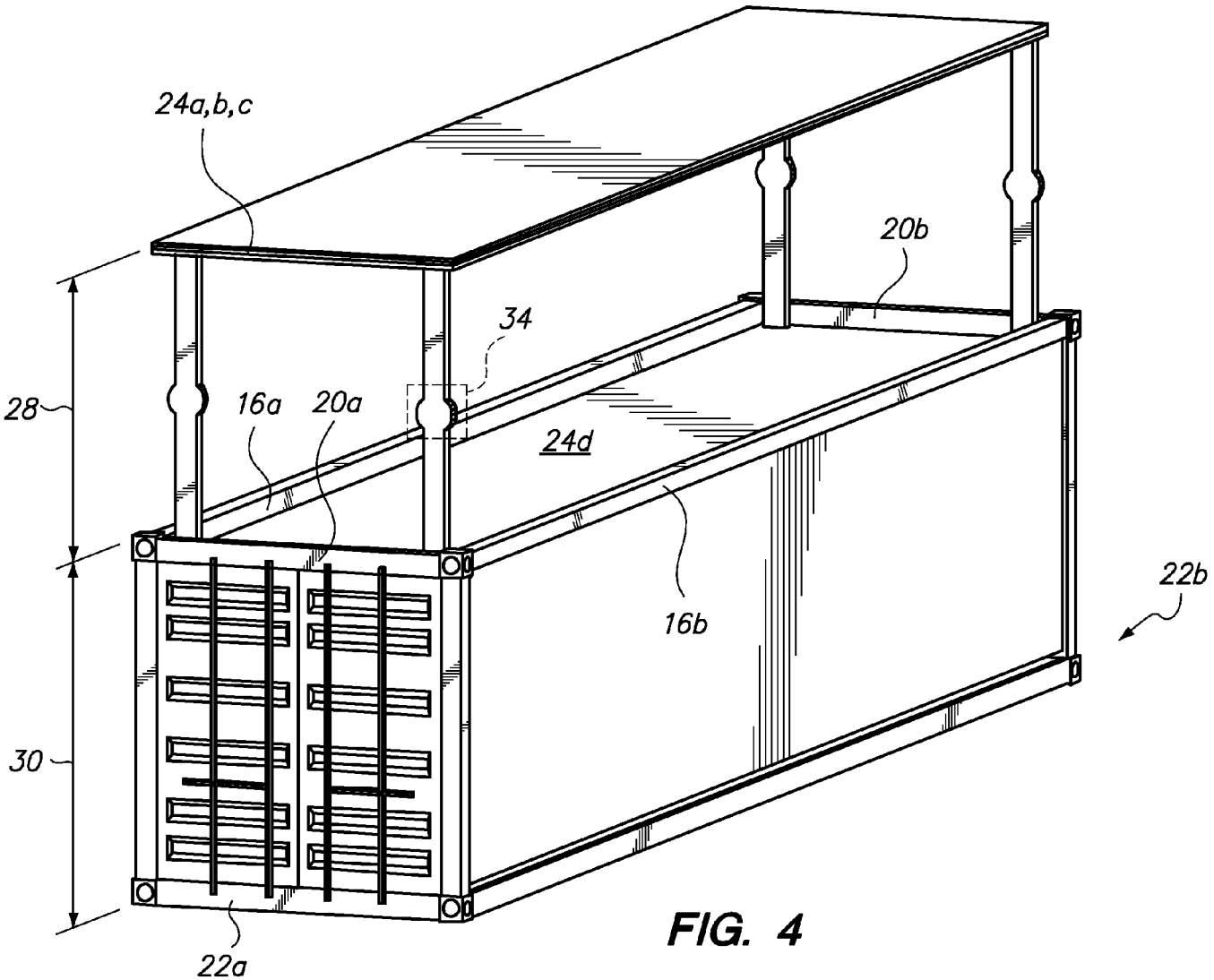
FIG. 4 illustrates completion of the raising the roof step shown in FIG. 3.

Referring now to FIGS. 3 and 4, three panels 24*a, b* and c are stacked upon each other and raised upward by way of pivoting structures 26. The panels 24*a-c* are raised so that a distance 28 between the panels 24*a-c* and the upper lateral and longitudinal members 20*a, b* and 16*a, b* is equal to a height or distance 30 between the upper lateral and longitudinal members 20*a, b*, 16*a, b* and the lower lateral and longitudinal members 22*a, b*, 18*a, b*. Alternatively, the distance 28 may be reduced to either provide a storage area above the first floor or a minimal height to allow people to work or live on the second story 14.

The pivoting structures 26 may include first and second pivoting arms 32*a, b*. The first and second pivoting arms 32*a, d* pivot about pivot joint 34 with respect to each other. Moreover, the first pivoting arm 32*a* pivots about panel 24*a*. The upper distal end of the first pivoting arm 32*a* is also pivotally attached to one of the four corners of the panel 24*a*. The lower distal end of the second pivoting arm 32*b* is secured to the interior of the corner defined by the upper lateral member 20*a*, first vertical end frame 12*b* and the upper longitudinal member 16*b*. The lower distal ends of the other second pivoting arms of the other pivoting structures 26 are attached to the interior of the respective corner defined by the upper lateral member 20, the vertical end frame 12 and the longitudinal member 16. When the pivoting structures 26 are fully extended, as shown in FIG. 4, the pivot joints 34 may be locked with a locking mechanism to prevent collapse of the panels 24*a-c*. A horizontal panel 24*d* is stationary and fixed to the upper longitudinal and lateral members 16*a, b*, 20*a, b* so as to form the floor of the second story 14 of the portable two-story housing structure 10. The panels 24*a-c* form the roof of the portable two-story housing structure 10 which are unfolded at a later time.

Figure 5:
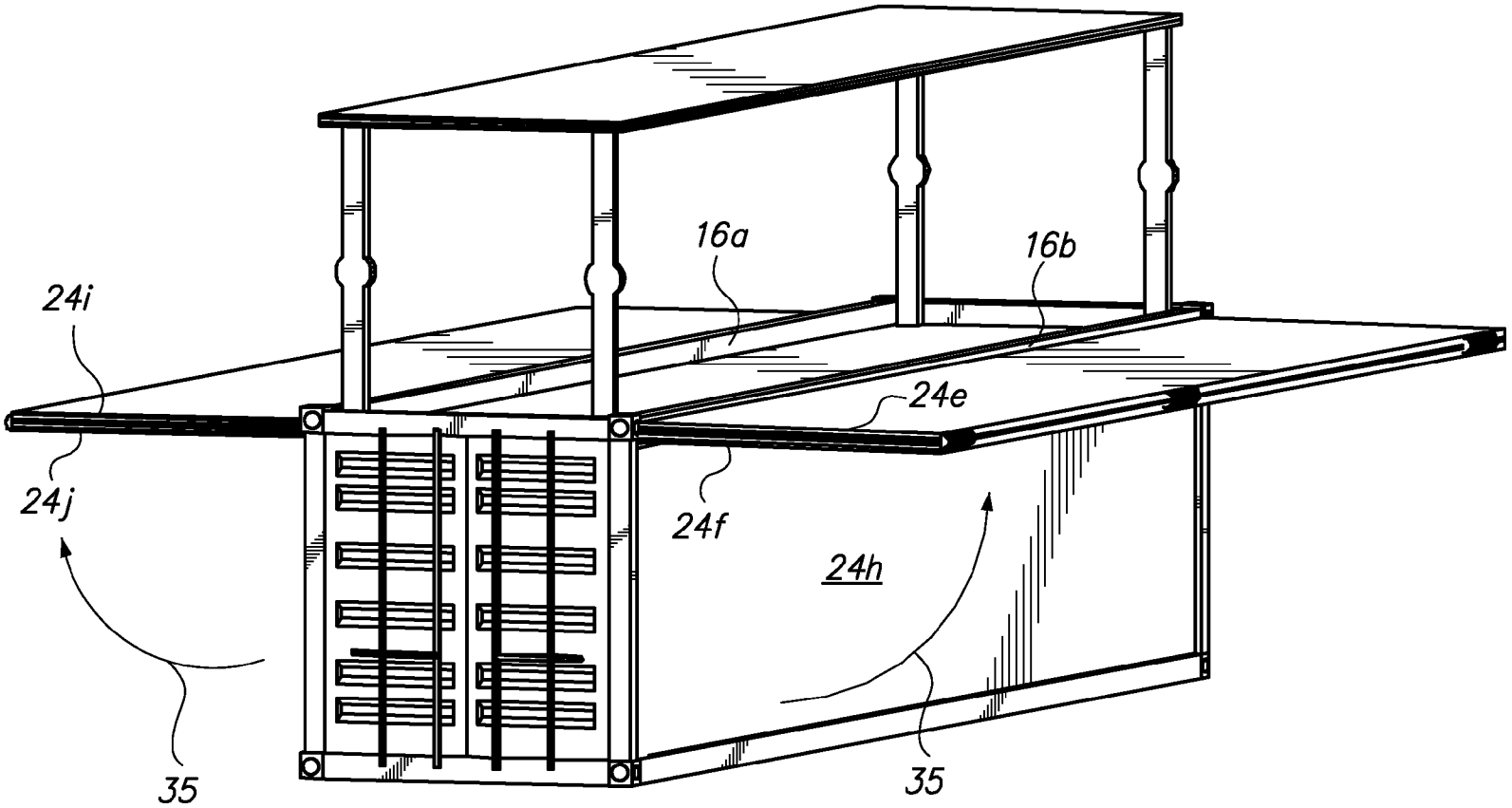
FIG. 5 illustrates pivoting floors of a second floor of the two-story housing structure shown in FIG. 4.
Figure 6:
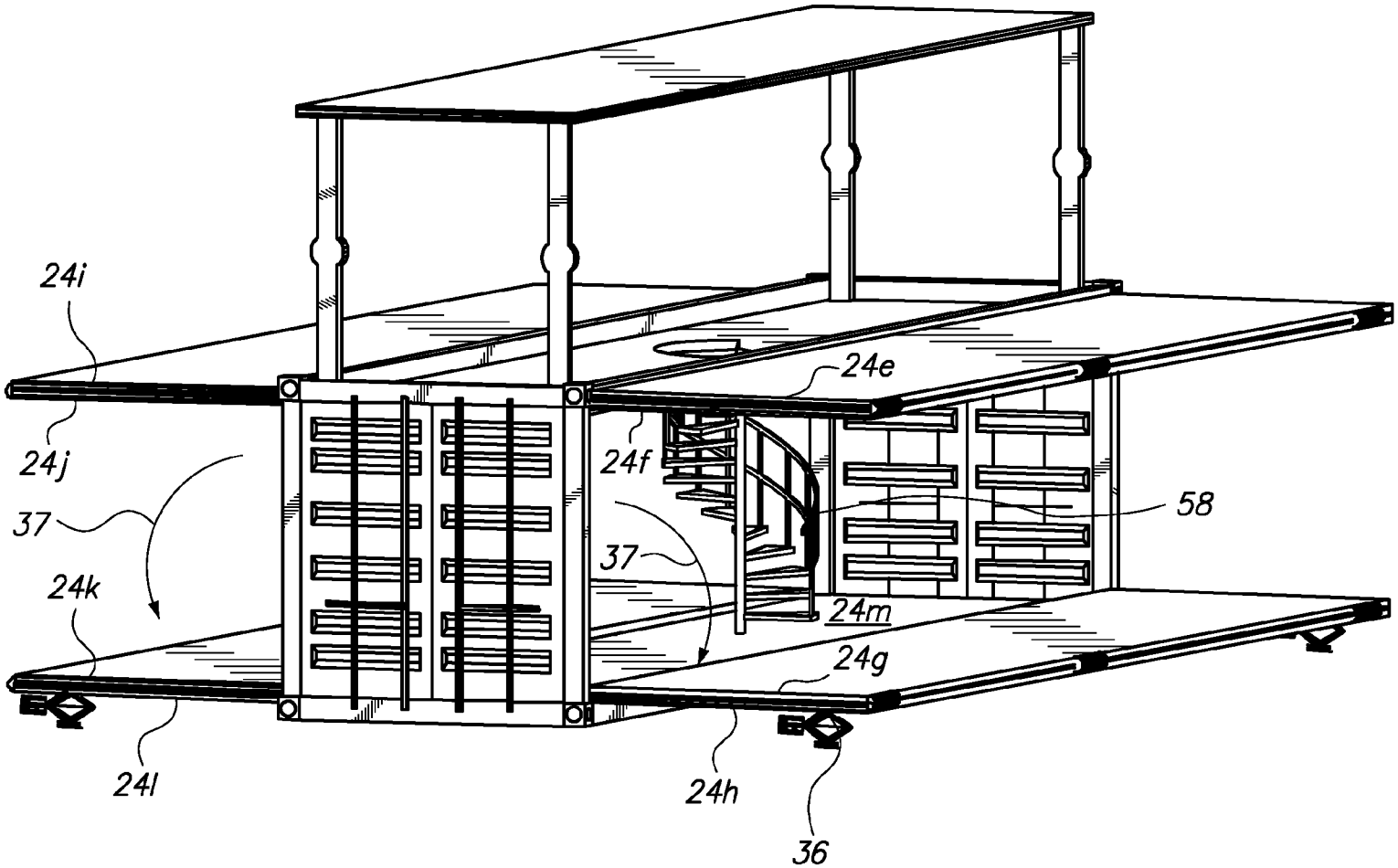
FIG. 6 illustrates pivoting floors of a first-floor of the two-story housing structure shown in FIG. 5.

Referring now to FIGS. 5-8, additional panels 24*e-l* (see FIGS. 6 and 7) may be pivoted into position. Initially, the panels 24*e, f* and 24*i, j* may be pivoted upward 35 as shown in FIG. 5. Moreover, the panels 24*f* and *j* are pivotally attached to the upper longitudinal members 16*a, b* or at upper distal end portions of the first and second vertical end frames 12*a-d*. Thereafter, the panels 24*g, h* and 24*k, l* are pivoted downward 37 as shown in FIG. 6. The panels 24*h, l* are pivotally attached to the lower longitudinal members 18*b, a* or at lower distal end portions of the first and second vertical end frames 12*a-d*.

A plurality of leveling mechanisms 36 (see FIG. 7) may be disposed underneath panels 24*h* and *l* to bring them horizontal to a first floor panel 24*m* or the ground.

Figure 7:
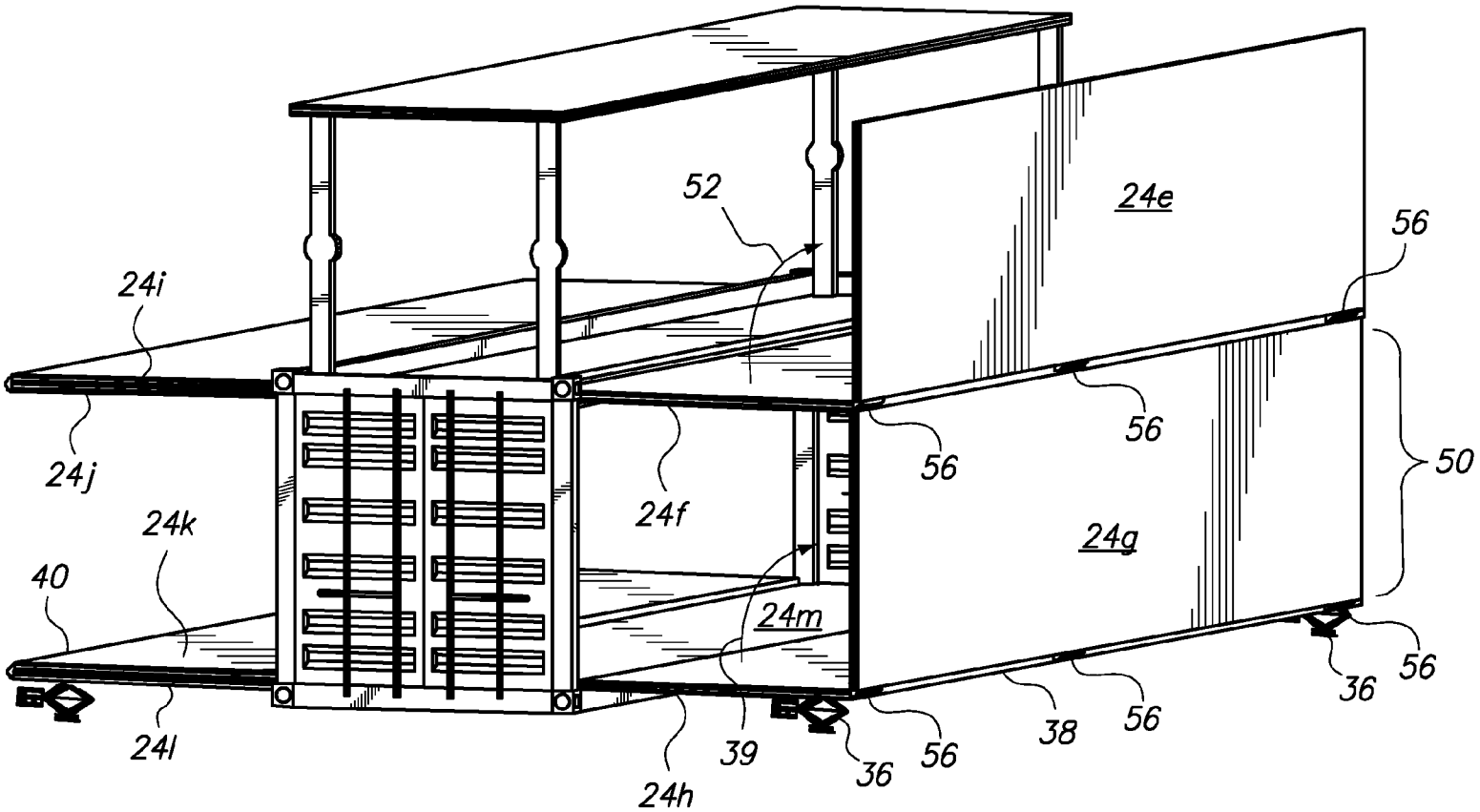
FIG. 7 illustrates pivoting walls of the first and second floors of the two-story housing structure shown in FIG. 6.
Figures 8, 8A, 8B:
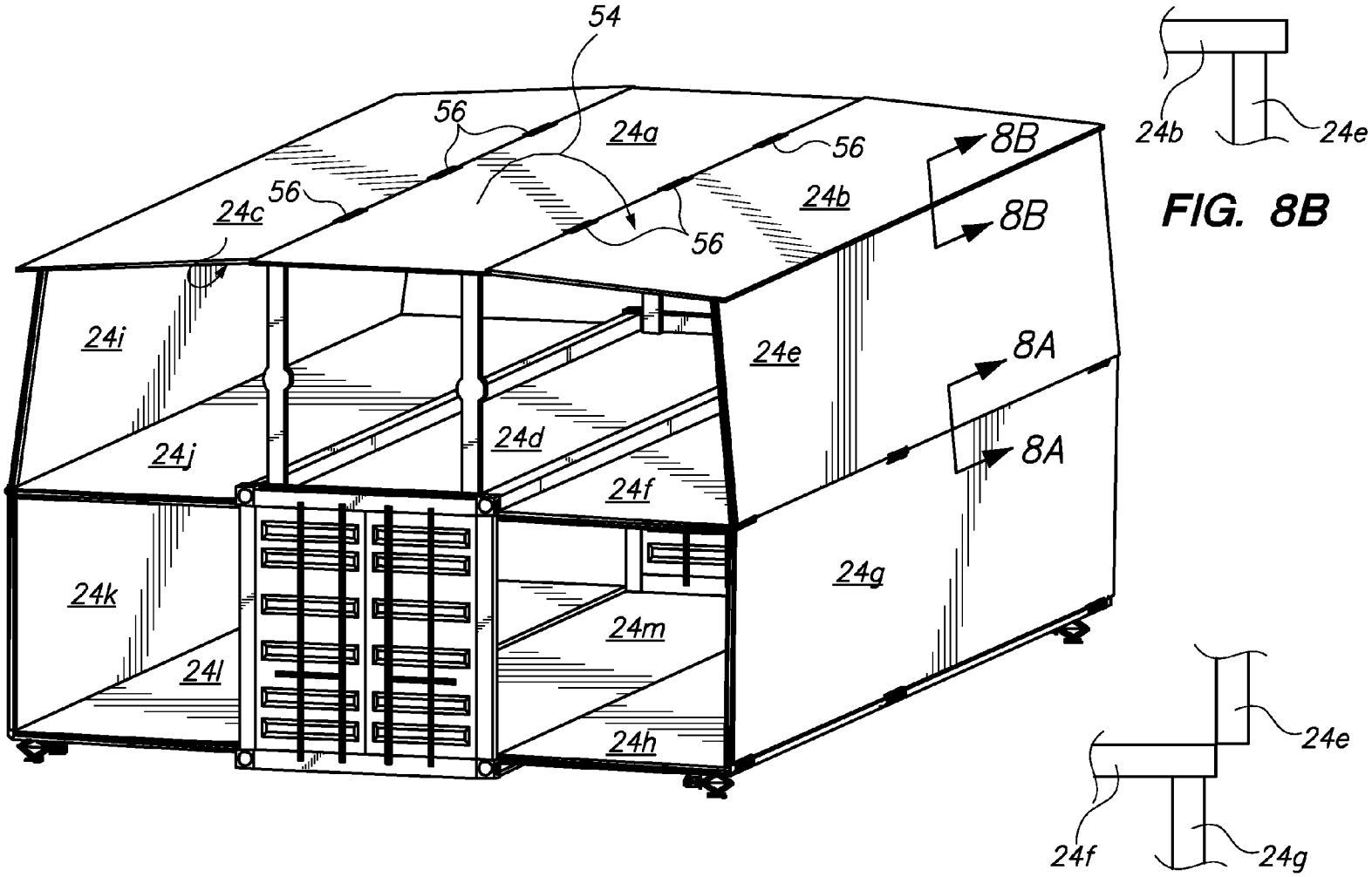
FIG. 8 illustrates pivoting panels of the roof of the two-story housing structure shown in FIG. 7.
FIG. 8A is a cross sectional view of the side floor panel extending over a wall panel.
FIG. 8B is a cross sectional view of the distal end of a roof panel extending over a wall panel.
Figure 9:
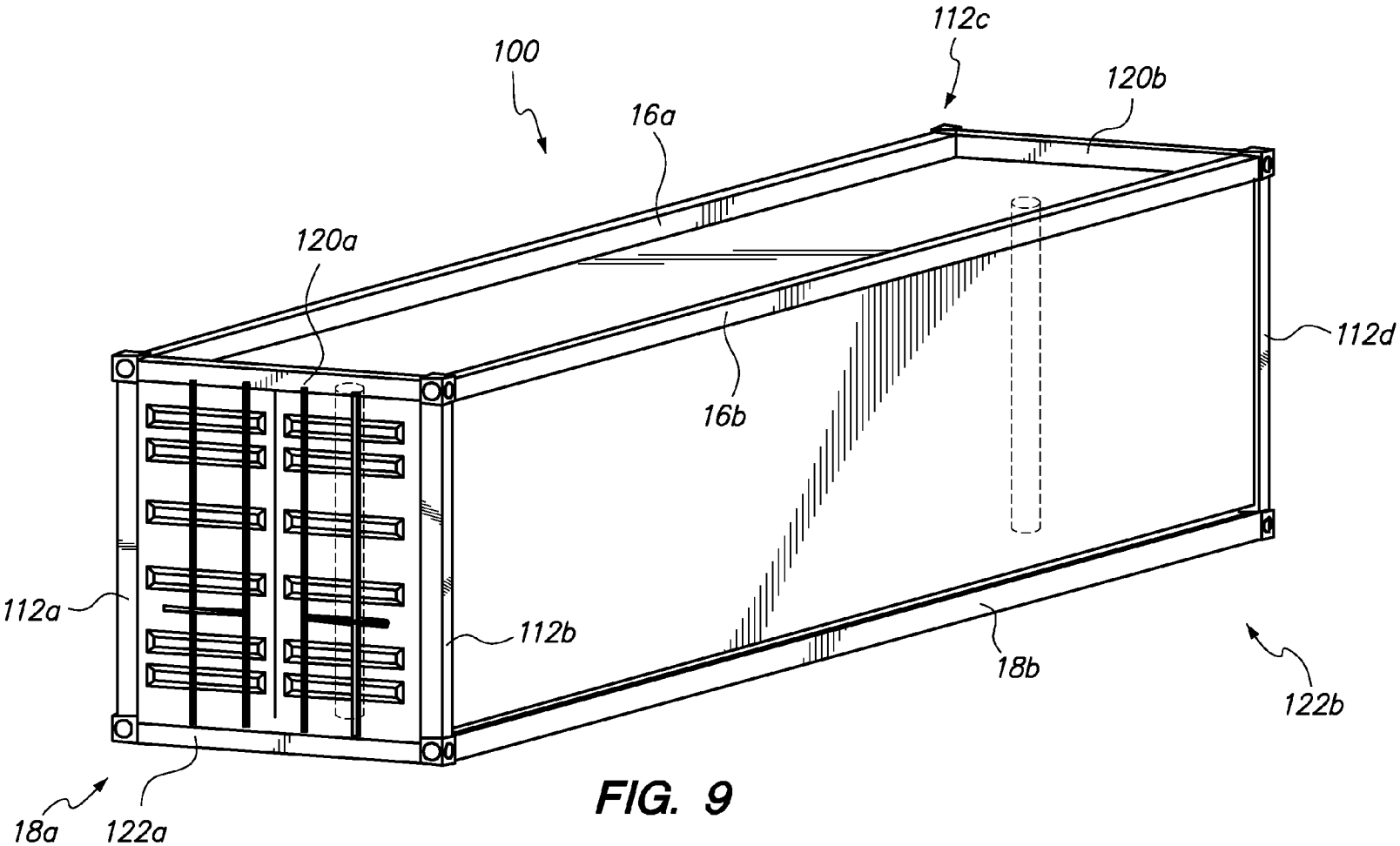
FIG. 9 is a perspective view of a second embodiment of the two-story housing structure in a collapsed state which is ready for transport via an intermodal transportation system.

The first floor panel 24*m* is stationary and fixed to the lower longitudinal and lateral members 18*a, b*, 22*a, b* so as to form a part of the floor of the first story 50 of the portable two-story housing structure 10. The panels 24*h, l* complete the floor of the first story 50 of the portable two-story housing structure 10. Panels 24*g* and 24*k* are pivoted upward 39 so that their upper distal edges are under the distal edges of the panels 24*f* and *j*. (See FIG. 8A). The panels 24*g* and *h* are pivotal with respect to each other about edge 38 on hinges 56. Also, panels 24*k* and *l* are also pivotal with respect to each other about edge 40 on hinges 56. The upper distal edges of the panels 24*g* and *k* can be secured or attached to the panels 24*f* and *j*. Moreover, panels 24*e* and *f* are pivotal with respect to each other on hinges 56 so that the panel 24*e* can be raised or pivoted 52 to the vertical position as shown in FIG. 7. Similarly, panels 24*i, j* are pivotal with respect to each other on hinges 56. Panel 24*i* may be pivoted 52 to the vertical position as shown in FIG. 8. After transitioning the panels 24*e, i* to the vertical position, the panels 24*b, c* are pivoted 54 outward on hinges 56 so that the upper distal edges of the panels 24*e, i* reside under the panels 24*b, c* and provide support for the distal end portions of the panels 24*e, i* to maintain the panels 24*b, c* in the horizontal position (see FIG. 8B).

Referring back to FIG. 2, sheer panels 42 may be attached to the vertical end frame 12*b* and the edge portion 44 of the panel 24*f*, edge portion 46 of the panel 24*g* and the edge portion 48 of the panel 24*h*. Additional shear panels 42 may also be attached at other locations. By way of example and not limitation, a shear panel 42*b* may be attached to the vertical end frame 12*a*, the edge portion 44 of the panel 24*j*, the edge portion 46 of the panel 24*k* and the edge portion 48 of the panel 24*l*. Although not shown, shear panels 42 may be attached to (1) the edge portions of the panels 24*c, i, j*, (2) edge portions of the panels 24*a, d* or the upper lateral member 20 and (3) edge portions of the panels 24*b, e, f*. Shear panels 42 may also be attached to the opposite side (not shown) to enclose the entire second story of the two-story housing structure to protect the contents disposed within the structure 10 and its inhabitants from the environment. The shear panels 42 provide rigidity to the erected structure 10 so that the various panels 24 do not tilt to the left or right and fall over. The shear panels 42 may also be formed with windows so that inhabitants may have an outside view and sunlight may penetrate into the interior of the structure 10.

The doors 56 may serve as the entrance to the portable two-story housing structure 10 and may be equipped with a traditional doorknob and locking features.

Additionally, the joints between the panels 24 and the shear panels 42 may be filled with weatherproofing to prevent air from escaping from within the erected structure 10. In doing so, any air conditioning routed to the housing structure 10 and used to heat or cool the inside of the erected structure 10 would be more efficient. Moreover, by weatherproofing the joints, moisture and water are not allowed to enter the erected structure 10.

The various panels 24 are all vertically disposed within the outer boundaries defined by the upper and lower longitudinal members 16*a, b*, 18*a, b*, and the first and second vertical end frame 12*a-d*. Moreover, space is still left within the collapsed structure 10 to provide for transport of the shear panels 42 and other accessories (e.g. chairs, desks, etc.).

The panels 24 may be layered to facilitate weatherproofing. For example, the distal end of the roof panels 24*b, c* may extend over the upper distal end of panels 24*e, i*, as shown in FIG. 8B. Also, the distal end of the side floor panels 24*f, j* that make up the floor of the second story may extend past the upper distal end of panels 24*g, k*, as shown in FIG. 8A. This allows rain water to cascade down the roof panels 24*b, c* onto the sides of sidewall panels 24*e, i* and cascade down the sides of sidewall panels 24*g, k* to help keep the inside of the structure 10 dry.

Referring now to FIGS. 9-14, a second embodiment of a portable two-story housing structure 100 is shown. The structure 100 also includes pairs of first and second vertical end frames 112*a-d*. The structure 100 also includes upper and lower lateral members 120*a, b*, 122*a, b*. The pairs of first and second vertical end frames 112*a* and the upper and lower lateral members 120*a, b*, 122*a, b* are longitudinally spaced apart by upper and lower longitudinal members 16*a, b*, 18*a, b*. The pairs of first and second vertical end frames 112*a-d*, upper and lower lateral members 120*a, b*, 122*a, b* and the upper and lower longitudinal members 116*a, b*, 118*a, b* define the external envelope of the portable two-story housing structure 10*a* when collapsed.

The pairs of first and second vertical end frames 112*a-d* may have corner castings (e.g., cast twistlock corners) on opposed ends thereof so that one or more collapsed portable two-story housing structures 100 can be stacked upon each other and transported via shipping, train or other standard intermodal transportation systems. Additionally, the vertical end frames 112*a-d* may also support the second story 114 (see FIG. 14) after the two-story portable housing structure 100 is erected. When the two-story housing structure 100 is erected, the weight of the second story 114 and the weight of the people and things on the second story 114 are transferred to the pairs of vertical end frames 112*a-d* through the upper longitudinal members 116*a, b*. The longitudinal members 116*a, b* may be sufficiently strong and stiff to mitigate excessive bending of the longitudinal members 116*a, b* during transportation and under the weight of the personnel and contents stored on the second story 114 when erected. The upper longitudinal members 116*a, b* may be attached to the upper distal ends of the pairs of first and second vertical end frames 112*a-d* (as shown) or the upper lateral members 120*a, b*. The lower longitudinal members 118*a, d* may be attached to the lower distal ends of the pairs of first and second vertical end frames 112*a-d* which provide structural support during transportation and when the structure 10*a* is erected.

A plurality of panels 124 are vertically stored within the overall external envelope of the collapsed structure 10*a*. These panels 124 are later traversed (e.g. rotated or pivoted) to form the floors of the first and second stories 150, 114, and roof of the portable two-story housing structure 100.

Figure 10:
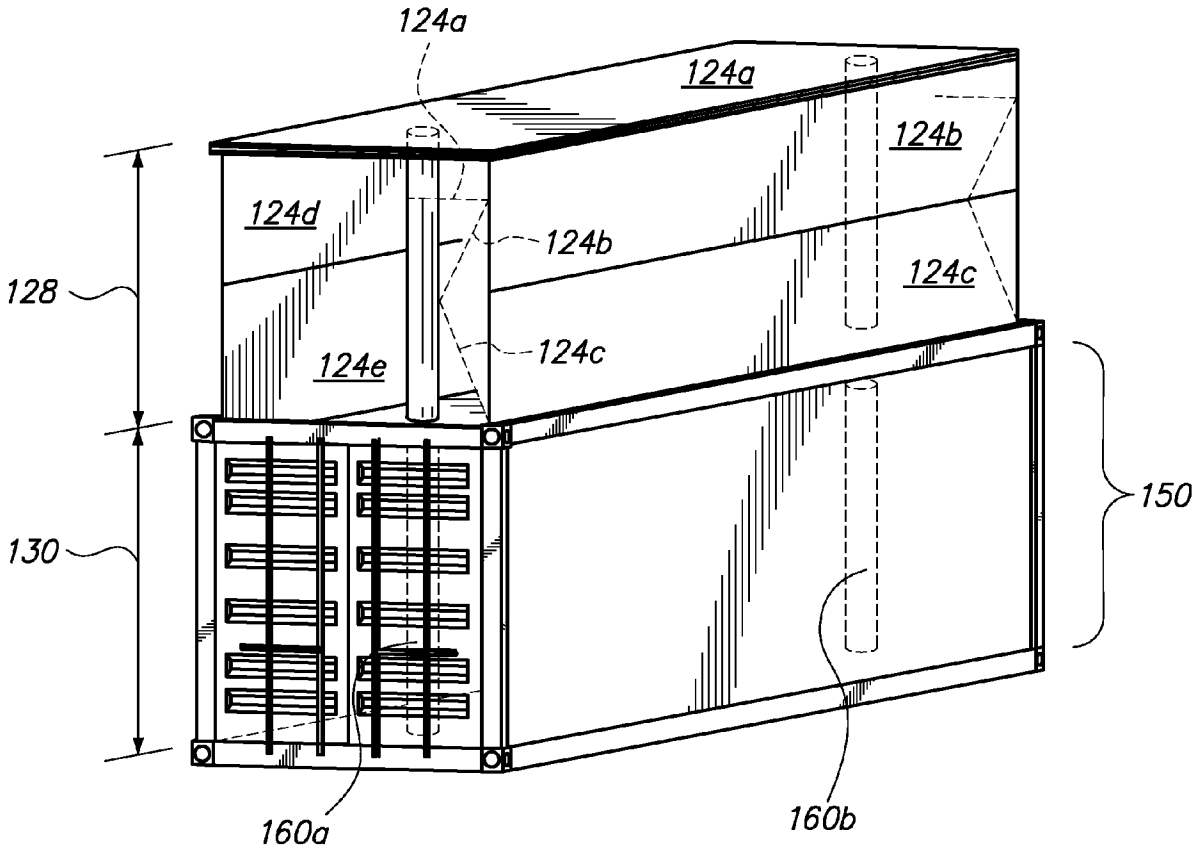
FIG. 10 illustrates a step of raising a roof of the two-story housing structure shown in FIG. 9.

Referring now to FIG. 10, a roof panel 124*a* may be raised up to a distance 128 that is preferably equal to or less than a distance 130 of a first story 150. However, it is also contemplated that the roof panel 124*a* may be raised to a distance 128 that is greater than distance 130. The roof panel 124*a* may be supported by telescoping columns 160*a, b* on opposed ends of the panel 124*a*. The telescoping column 160*a, b* may have a first part that can slide within a second part. When the telescoping columns 160*a, b* are extended to the appropriate height, the telescoping columns 160*a, b* may be locked in place either with a pin or other locking mechanism to prevent the roof panel 124*a* from collapsing. Instead of telescoping columns 160*a, b*, it is also contemplated that the roof panel 124*a* may be supported by pivot joint 34 and pivoting arms 32*a, d* as described in relation to the embodiments shown in FIGS. 1-8. When the roof panel 124*a* is raised up and locked in place by the telescoping columns 160*a, b*, two panels 124*b, c* and 124*d, e* on opposed lateral sides of the roof panel 124*a* are also unfolded. The panels 124*b, c* and 124*d, e* were tucked under the roof panel 124*a*. These panels 124*b-e* are later raised and pivoted to complete the roof of the two-story housing structure 100.

Figure 11:
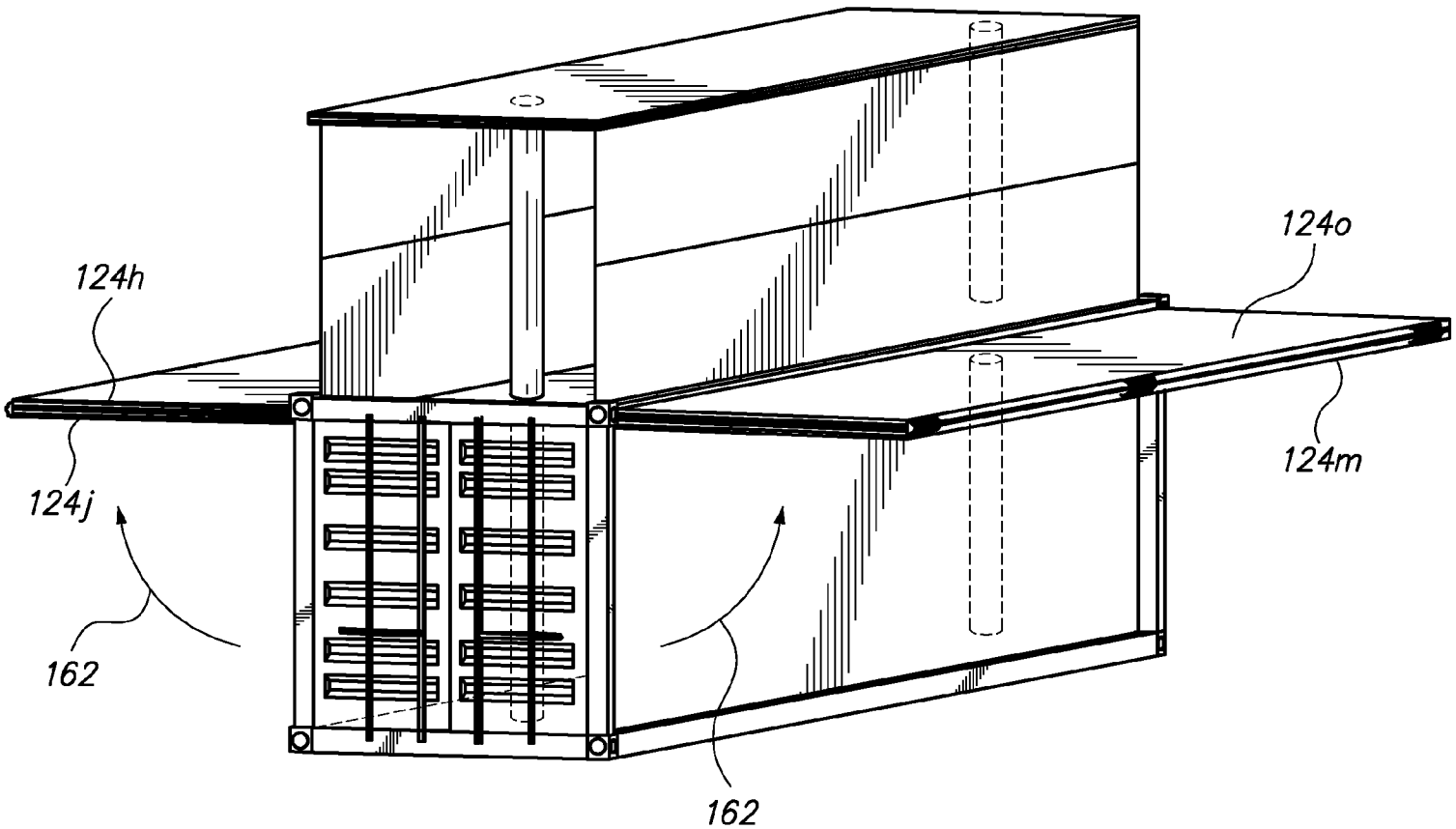
FIG. 11 illustrates pivoting floors of a second floor of the two-story housing structure shown in FIG. 10.
Figure 12:
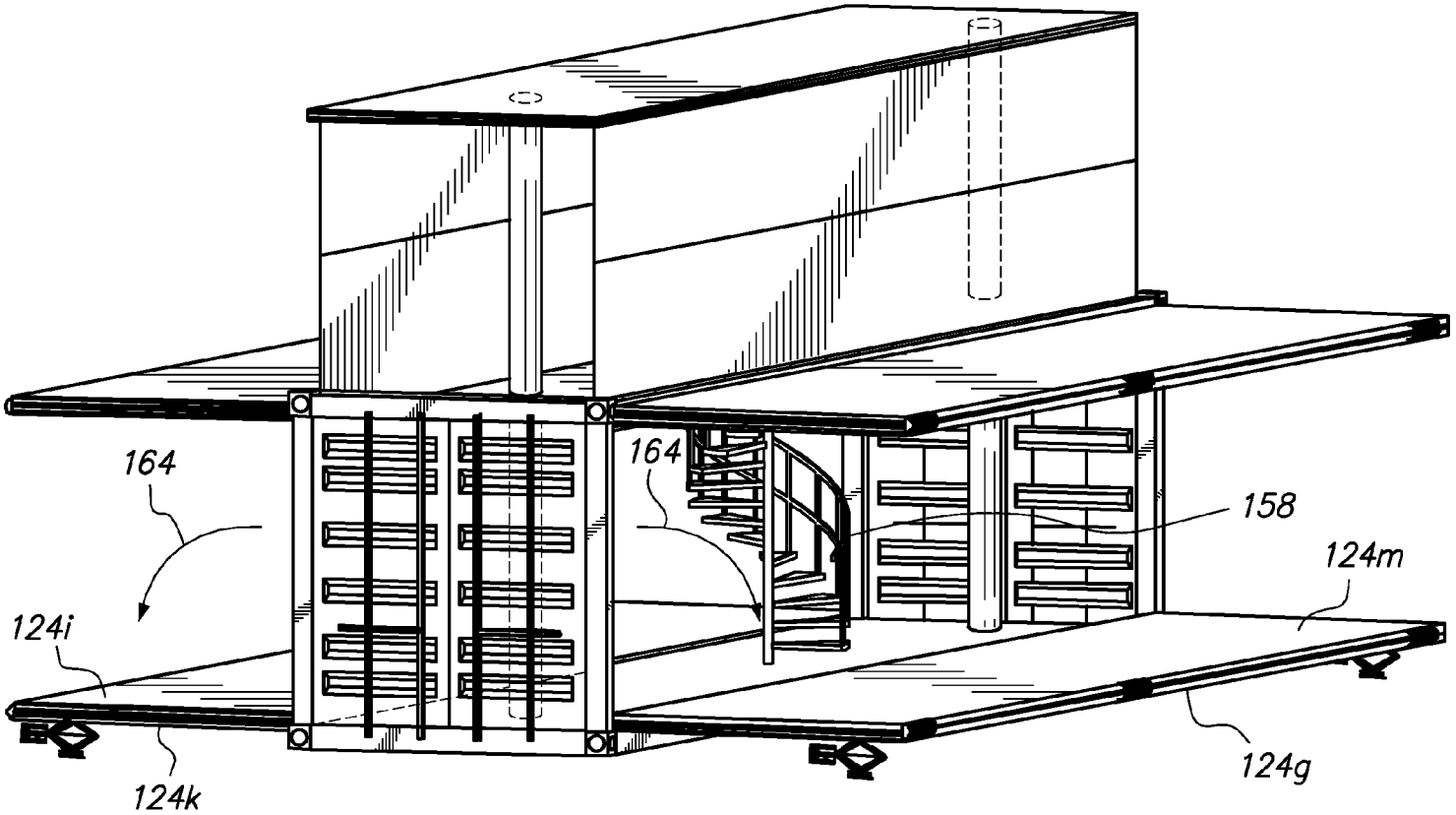
FIG. 12 illustrates pivoting floors of the first floor of the two-story housing structure shown in FIG. 11.
Figure 13:
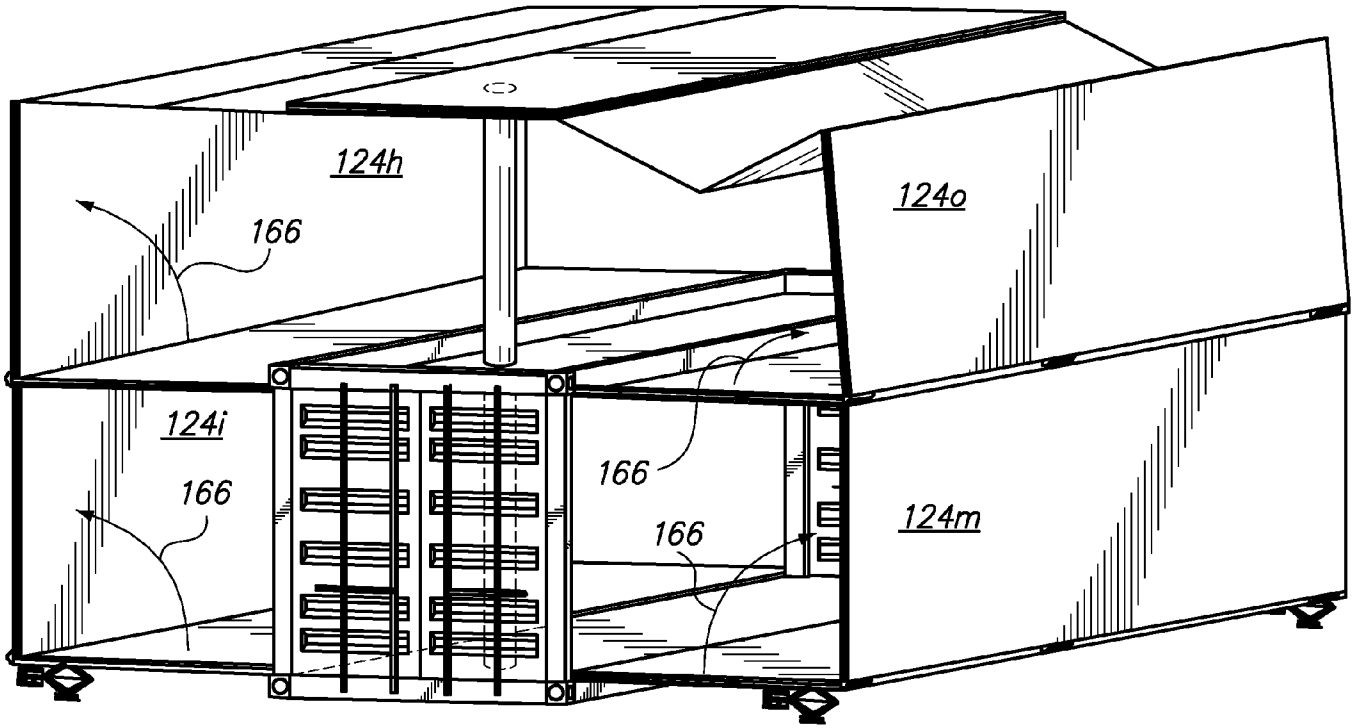
FIG. 13 illustrates pivoting walls of the first and second floors of the two-story housing structure shown in FIG. 12.
Figure 14:
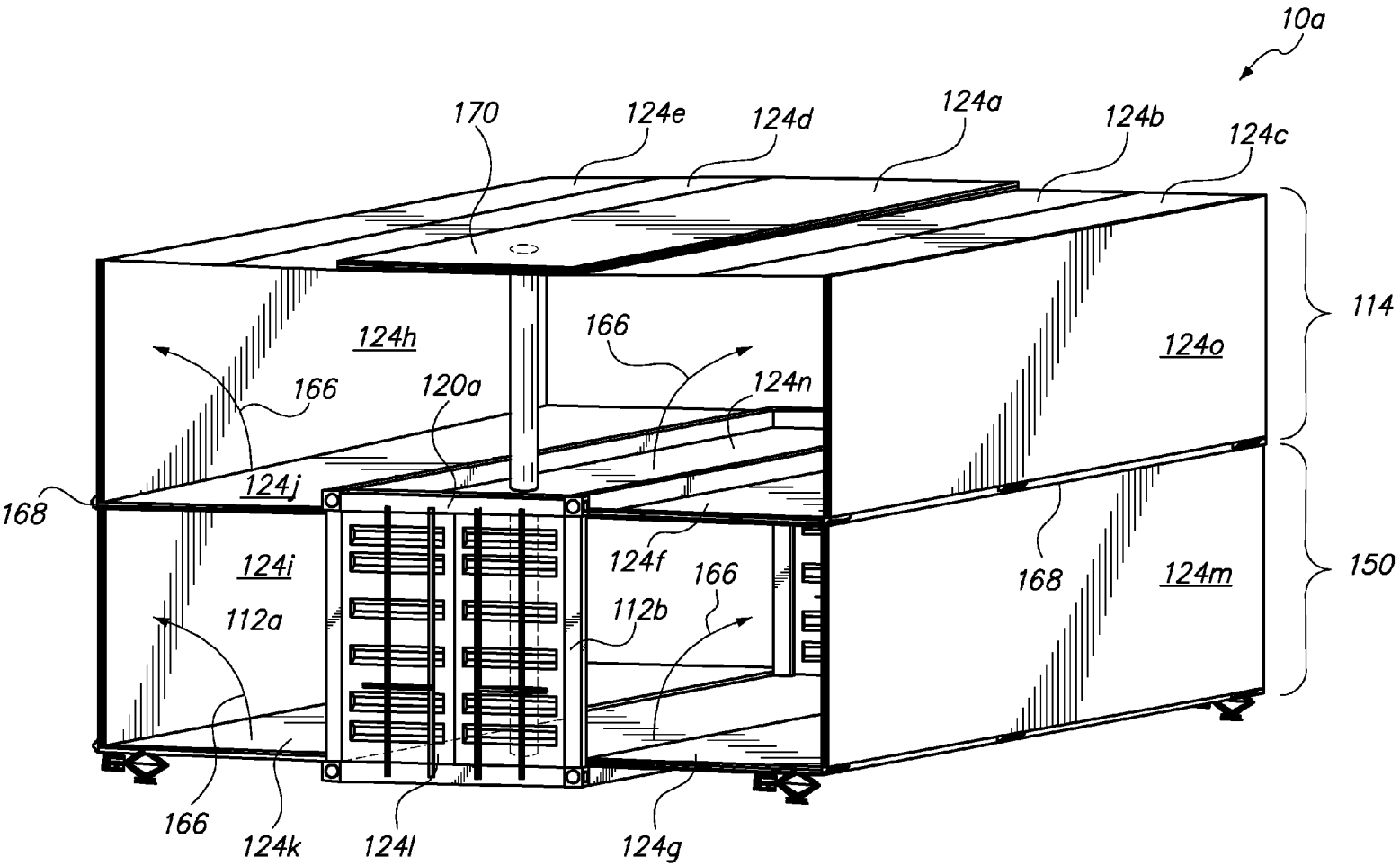
FIG. 14 illustrates the two-story housing structure shown in FIG. 9 when erected.

Referring now to FIG. 11, the panels 124*f, o* and 124*h, j* are pivoted 162 upward. Thereafter, the panels 124*m, g* and 124*i, k* are pivoted 164 downward as shown in FIG. 12. The sidewall panels 124*o, m, h, i* are pivoted 166 upward as shown in FIGS. 13 and 14. The upper distal ends 168 of the panels 124*i, e* may be secured or attached to a bottom side of the panels 124*j, f*. In this manner, water cascades off of the sidewall panels 124*o, h* of the second story 114 and on to the sidewall panels 124*m, i* of the first story 150 to help with waterproofing the two-story housing structure 100.

Sheer panels 124 are vertically stored within the collapsed portable housing structure 100. The sheer panels 124 may now be secured to opposed longitudinal edges of the panels 124*a-l* and to the upper and lower lateral members 120*a, b*, 122*a, b* and the pairs of first and second vertical end frames 112*a-d*. These sheer panels 124 prevent the various panels 124*a-l* from pivoting during a side wind or lateral forces. By way of example and not limitation, the sheer panels 124 may be placed between the edge portion 170 of the roof panel 124*a* and the upper lateral member 120*a*. In this manner, the weight of the panel 124*a* is transferred to the vertical end frames 112*a, b* through the sheer panel 124, to the upper lateral member 128 and ultimately to the vertical end frames 112*a, b*. Another sheer panel may also be placed on the opposed side (not shown). Sheer panels may be attached to (1) the edge portions of panels 124*j, i, k* and vertical end frame 112*a*, (2) the edge portions of panels 124*g, m, f*, (3) the edge portions of panels 124*f, o, c, b* and (4) edge portions of panels 124*j, h, e, d* as well as on the opposed sides. The sheer panels 124 help to prevent the panels 124 from tipping over and maintains rigidity of the housing structure 100.

The various panels 24 and 124 are described as being pivotal with respect to other panels 24, 124. In this instance, the panels 24, 124 may be attached to each other with hinges 56. These hinges 56 may be stainless steel to mitigate rusting while the collapsed portable housing structure 10, 100 is being transported to a site. The hinges 56 may be heavy duty hinges to hold up to the harsh environment in which these housing structures 10, 100 will be installed.

The housing structure 10, 100 after being erected may be sealed with weatherproofing to prevent moisture from entering the erected housing structure 10, 100. By way of example and not limitation, the sealant may be caulking, silicone, coating, vinyl or rubber weather stripping, etc.

The first floor of the housing structure 10 is defined by panels 24*h, l, m*. Panel 24*m* may be lower than panel 24*h, l*. In this instance, filler material may be placed on the panel 24*m* to raise the level of the middle section to be level with the panels 24*l, h*. The second floor of the housing structure 10 is defined by panels 24*j, d, f*. The upper longitudinal members 16*a, b* may separate the panels 24*j, d, f*. Filler material may be placed on the panels 24*j, d, f* and to cover the upper longitudinal members 16*a, b* so that the floor of the second story 14 is level. The same may be applied to panels 124*k, l* and *g*. The filler material may be light weight so that excessive weight is not placed on the structure 10. The filler material is also durable to withstand daily use. The portable housing structure 10, 100 has two stories. The first stories of the housing structures 10, 100 may have a spiral staircase 58, 158 so that personnel may travel between the first and second stories. The staircase 58, 158 are shown in FIGS. 6 and 12 but not in the other figures for the purposes of clarity. The staircase 58, 158 would access the second story of the housing structure 10, 100 through a hole in the panels 24*d* (see FIG. 8) and 124*n* (see FIG. 14).

The structure 10, 100 may be fabricated from various materials to achieve the objective discussed herein. The upper and lower longitudinal members 16*a, b*, 18*a, b* and the upper and lower lateral members 20*a, b*, 22*a, b* and the first and second pairs of end frames 12*a-d* may be fabricated from a material sufficiently strong and stiff to act as a frame for the structure 10, 100 during transportation and after the structure 10, 100 is erected. By way of example and not limitation, the upper and lower longitudinal members 16*a, b*, 18*a, b* and the upper and lower lateral members 20*a, b*, 22*a, b* and the first and second pairs of end frames 12*a-d* may be fabricated from steel, aluminum, steel or aluminum tubing, or other similar materials. The panels 24, 124 may be fabricated from a weather resistant material that can withstand sustained light impact. By way of example and not limitation, the panels 24, 124 may be fabricated from materials such as steel, aluminum, sheet metal (e.g., steel), galvanized sheet metal, composite material, carbon fiber composite material, carbon fiber, plastic, thermo plastic, composite wood and the like.

The various panels 24, 124 has been illustrated as being solid. However, it is also contemplated that one or more of the panels 24, 124 may be fabricated in a honey comb structure with external sheets adhered to the honeycomb structure to prevent water and air from passing through the panel 24, 124. The panels 24, 124 may be fabricated from any of the materials discussed above. Alternatively, it is also contemplated that the panels 24, 124 forming the sidewalls of the structure 10, 100 after erected may provide a framework for the sidewalls of the structure 10, 100. After these sidewall panels 24, 124 are set in place, a thin flexible covering may be used to cover the framework to provide protection from the environment.

The structure 10, 100 disclosed herein may be utilized for the following purposes including but not limited to: mobile housing, mobile hospital, mobile barracks, mobile command center, construction office with the first floor being an equipment storage area, mobile media room such as a mobile newsroom or production studio, mobile retail venue, mobile marking venue, mobile restaurant, semipermanent structure as remote locations, mobile laboratory, mobile communications center, temporary office space or any place where an enclosed space is needed and shipping costs are at a premium.

The structure 10, 100 may also include an HVAC system, electrical wiring connections and lighting which are routed through the non pivoting parts of the structure 10, 100.

The structure 10, 100 may be scalable to any length such as 20 feet, 40 feet for international shipping and 53 feet for domestic shipping.

The above description is given by way of example, and not limitation. Given the above disclosure, one skilled in the art could devise variations that are within the scope and spirit of the invention disclosed herein, including various ways of rotatably connecting adjacent panels 24, 124. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A portable two story housing structure, said structure being dimensioned as a standard intermodal transportation container when in a collapsed state, the structure comprising:

a pair of rigid first vertical end frames to support a second story of the portable two story housing structure and to stack one or more portable two story housing structures upon each other during transportation, the rigid first vertical end frames having upper and lower distal end portions and a length being equal to the height of a standard intermodal transportation container;

a pair of rigid second vertical end frames to support the second story of the portable two story housing structure and to stack one or more portable two story housing structures upon each other during transportation, the rigid second vertical end frames having upper and lower distal end portions and a length being equal to the height of a standard intermodal transportation container;

a pair of upper longitudinal members having a length being equal to the depth of a standard intermodal transportation container and attached to the upper distal end portions of the pairs of first and second vertical end frames;

a pair of lower longitudinal members having a length being equal to the depth of a standard intermodal transportation container and attached to the lower distal end portions of the pairs of first and second vertical end frames;

a pair of upper lateral members having a length being equal to the width of a standard intermodal transportation container and attached to the upper distal end portions of the pairs of first and second vertical end frames;

a pair of lower lateral members having a length being equal to the width of a standard intermodal transportation container and attached to the lower distal end portions of the pairs of first and second vertical end frames;

corner castings fitted on the upper and lower distal end portions of the pairs of first and second vertical end frames, wherein the corner castings are positioned so that the portable two story housing structure may be transported through a standard intermodal transportation system;

at least one door disposed between at least one of the pairs of vertical end frames;

a floor panel attached to the lower longitudinal and lower lateral members;

a horizontal panel attached to the upper longitudinal and upper lateral members;

first, second, and third top panels disposed adjacent to the horizontal panel, the top panels being traversable upward so as to form a roof of the portable housing structure, wherein the second and third top panels are rotatably attached to the first top panel;

an elevating mechanism attached to the first top panel, wherein the elevating mechanism is configured to traverse the top panels upward and lock in an extended position;

upper panels pivotally attached to the upper longitudinal members, the upper panels being rotatable into position to form the floor and side walls of the second story of the structure; and lower panels pivotally attached to the lower longitudinal members, the lower panels being rotatable into position to form the floor and side walls of the first story of the structure, wherein the vertical frames, lateral members, and longitudinal members define the outer envelope of the structure when in a collapsed state.

2. The structure of claim 1 further comprising shear panels attachable to the side walls, floor, roof and vertical frames to fully enclose the two story structure.

3. The structure of claim 1 further comprising level mechanisms for leveling a floor of the two story housing structure when erected.

4. The structure of claim 1, wherein the elevating mechanism comprises two pairs of pivoting structures, the pivoting structures comprised of first and second pivoting arms and a pivot joint disposed between the first and second pivoting arms, wherein the first pivoting arm is attached at a distal end to a corner defined by an intersection of an upper lateral member, an upper longitudinal member, and an upper distal end portion of a vertical end frame, and wherein the second pivoting arm is attached at a corner of the first top panel.

5. The structure of claim 1, wherein the elevating mechanism comprises a pair of telescoping columns, each column comprised of a first column part attached to the first top panel, the first column part being configured to slide within a second column part attached to the floor panel, wherein the telescoping columns are located at opposed ends of the structure and pass through the horizontal panel.

* * * * *